United States Patent [19]

Stockman

[11] 4,313,489

[45] Feb. 2, 1982

[54] TURNDOWN INDICATOR FOR ROTARY REGENERATIVE HEAT EXCHANGER

[75] Inventor: Richard F. Stockman, Friendship, N.Y.

[73] Assignee: The Air Preheater Company, Inc., Wellsville, N.Y.

[21] Appl. No.: 123,590

[22] Filed: Feb. 22, 1980

[51] Int. Cl.[3] ..... F28D 19/00

[52] U.S. Cl. ..... 165/9; 165/11R

[58] Field of Search ..... 165/9, 11

[56] References Cited

U.S. PATENT DOCUMENTS 4,206,803 6/1980 Finnemore et al. ..... 165/9

FOREIGN PATENT DOCUMENTS 983474 2/1976 Canada ..... 165/9

*Primary Examiner*—Albert W. Davis

*Attorney, Agent, or Firm*—William W. Habelt

[57] ABSTRACT

A rotary regenerative heat exchange apparatus having a rotor 10 carrying a mass of heat absorbent material that is ultimately exposed to a hot and a cold fluid in order that heat absorbed from the hot fluid may in turn be transferred to the cold fluid. The rotor 10 is surrounded by a housing 18 including a sector plate 30 at the hot end of the rotor that separates the fluids. A turndown indicator 40 operatively associated with the hot end sector plate 30 is provided so that the operator may at any time determine the amount of turndown of the rotor thereby permitting adjustment of the sector plate or other sealing means to reduce to a minimum any fluid leakage between the hot and cold fluids throughout a wide range of temperature variation and thermal expansion.

4 Claims, 5 Drawing Figures

TURNDOWN INDICATOR FOR ROTARY REGENERATIVE HEAT EXCHANGER

BACKGROUND OF THE INVENTION

The present invention relates to rotary regenerative heat exchangers and, more particularly, to an apparatus for accurately determining the amount of turndown of the rotor during operation of the rotary regenerative heat exchanger.

In a rotary regenerative heat exchange apparatus such as an air preheater, a mass of heat absorbent material commonly comprised of packed plate-like elements carried in a rotor shell is alternately positioned first in a hot fluid passageway and then in a cold fluid passageway as the rotor shell rotates about a central rotor shaft. At one position in the hot fluid passageway, the heat absorbent material absorbs heat from the hot fluid passing therethrough. After the heat absorbent material has been heated by the hot fluid, it is positioned in a cold fluid passageway where the then hot heat absorbent material transmits its heat to the cold fluid passing therethrough. A fixed housing, including sector plates disposed at opposite ends of the rotor, is adapted to surround the rotor shell wherein the heat absorbent material is carried. To prevent intermingling of the hot fluid and the cold fluid as they pass through the heat exchange apparatus, the sector plates are adapted to lie in sealing relationship with flexible radial seals mounted on the end faces of the rotor shell at spaced intervals about the central rotor posts. Additionally, axial seals are provided at the outboard circumferential surface of the rotor shell to prevent the hot fluid or the cold fluid from bypassing the heat absorbent material carried within the rotor shell.

In a standard rotary heat exchange apparatus such as the air preheater described herein, the hot fluid, hereinafter referred to as the hot gas, and the cold fluid, hereinafter referred to as cold air, enter the rotor shell from opposite ends and pass in opposite directions over the heat exchange material housed within the rotor shell. For example, if such a heat exchange apparatus is disposed horizontally to rotate about a vertical shaft, the hot gas enters the top of the heat exchanger and flows vertically downward through one side of the rotor, transferring its sensible heat to the heat absorbent material rotating therethrough with the cooled gas exiting at the bottom of the heat exchanger. At the same time, cold air enters the bottom of the heat exchanger and flows vertically upward through the other side of the rotor picking up sensible heat from the heat absorbent material rotating therethrough with the heated air exiting at the top of the heat exchanger.

Inasmuch as the cold air inlet and the cooled gas outlet are at the bottom of the heat exchanger and the hot gas inlet and the heated air outlet are at the top of the heat exchanger, an axial temperature variation exists within the rotor shell with the top end of the rotor being the hot end and the bottom end of the rotor being the cold end. In response to this thermal gradient, the rotor tends to "turndown," i.e., to distort and assume a shape similar to that of an inverted dish. As a result of such a turndown, the radial seals mounted on the upper and lower surfaces of the rotor, i.e., the hot end, are pulled away from the sector plate with the greatest separation occurring at the outboard end of the rotor, thereby allowing fluid leakage therebetween resulting in the undesired intermingling of gas and air.

Various schemes of compensating for the loss of sealing effectiveness at the hot end of the rotor as a result of "turndown," such as U.S. Pat. No. 3,786,868 and U.S. Pat. No. 4,124,063, have been proposed wherein the upper sector plate is adjusted, i.e., bent downward, to recontact the radial seals mounted on the upper surface of the rotor. However, before the sector plate is adjusted, it is desirable to know the amount of turndown, particularly at the outer end of the rotor so that the radial seals will not be damaged by an operator who unknowingly overcompensates for the turndown. In the past, a spring loaded rod was commonly used to detect the position of the radial seals with respect to the sector plate after rotor turndown. The operator would manually push the rod against the force of the spring into contact with the radial seals and take a measurement of the linear displacement of the rod as a means of indicating the amount of turndown. Upon releasing the rod, the spring would recoil and return the rod to its normal position. In many instances, however, the operators would inadvertently continue to push the rod inward without realizing the rod had made contact with the radial seals resulting in the seals being damaged or the rods being bent and thus rendered inoperative.

SUMMARY OF THE INVENTION

It is an object of the present invention to permit an accurate determination of the amount of turndown to be made while at the same time eliminating the aforementioned problems of the prior art turndown indicator.

In accordance with the present invention, a turndown indicator is provided comprising a generally semicircular swing cam pivotally mounted on and cantilevered from the outboard end of the sector plate and connected by a flexible cable assembly to a fluidic cylinder mounted externally of the rotor housing. The fluidic cylinder serves to cushion and control the movement of the swing cam when it contacts the radial seal of the rotor.

When the swing cam contacts the seal, fluid is exhausted from the fluidic cylinder cushioning the impact and halting further movement of the swing cam. Repeated contact of successful radial seals with the swing cam as the rotor rotates dampens out further movement of the swing cam. When the swing cam has assumed a steady-state position, the displacement of an indicator means operatively associated with the swing cam provides the operator with an accurate measurement of the amount of turndown experienced by the rotor.

DESCRIPTION OF THE PREFERRED EMBODIMENT

Figure 1:
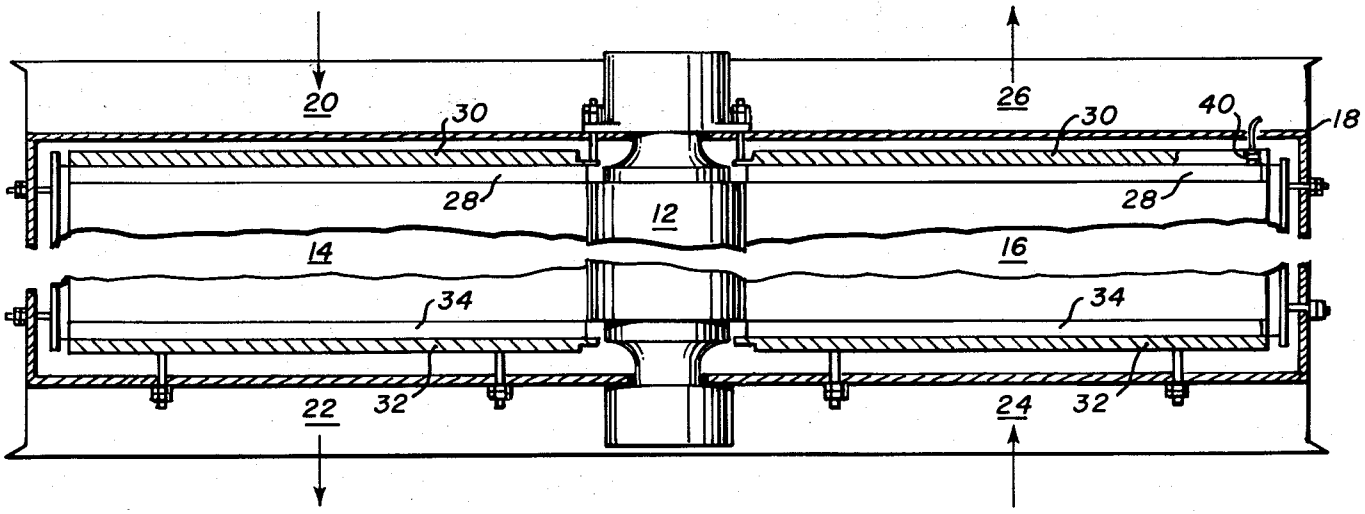
FIG. 1 is an elevational view, partly in section, of a rotary regenerative heat exchange apparatus employing a turndown indicator of the present invention.

Referring now to the drawing, there is depicted a rotary regenerative heat exchange apparatus, specifically an air preheater, of the type wherein a hollow cylindrical rotor 10 rotates a mass of heat absorbent material carried therein about a central rotor post 12. As the rotor 10 rotates, the heat absorbent material is alternately disposed in a gas passageway 14 and an air passageway 16 defined within the rotor housing 18. When positioned in the gas passageway 14, the heat absorbent material absorbs heat from the hot gas passing therethrough; and when positioned in the air passageway 16, the heated heat absorbent material transfers heat to the cold air passing therethrough. In this manner, the cold air is heated and the hot gases cooled without direct contact or intermingling with each other.

In the air preheater arrangement illustrated in the drawing, the hot gas enters the rotor housing 18 from the top through hot gas inlet 20, passes vertically downward through the gas passageway 14 losing heat to the heat absorbent material passing therethrough and discharges as cool gas through the cool gas outlet 22 located at the bottom of rotor housing 18. Conversely, the cold air enters through the cold air inlet 24 located at the bottom of rotor housing 18, passes vertically upward through the air passageway 16 picking up heat from the hot heat absorbent material rotating therethrough and discharged as heated air through the hot air outlet 26 at the top of rotor housing 18.

Inasmuch as the cold air inlet 24 and the cool gas outlet 22 are located adjacent each other at the bottom of the rotor housing 18, the bottom portion of the heat exchanger is termed the cold end and the top portion of heat exchanger is termed the hot end since the hot gas inlet 20 and the hot air outlet 26 are located adjacent each other at the top end of the rotor housing 18. It will be apparent that during operation the hot end of the rotor 10 will be subjected to a much greater temperature increase from ambient conditions than the cold end of the rotor 10 will be subjected to. Therefore, an axial temperature variation will exist within the rotor 10 with the greatest thermal expansion occurring at the hot end and the least thermal expansion occurring at the cold end of the rotor. In response to this thermal gradient, the rotor 10 tends to turndown, i.e., to distort and assume a shape similar to that of an inverted dish as illustrated diagrammatically in FIG. 2.

As a result of this turndown, the radial seals 28 mounted on the upper end face of the rotor 10 are pulled away from the upper sector plate 30 with the greatest separation occurring along the outer circumference of the rotor 10. Consequently, fluid leakage can occur therethrough resulting in the undesired intermingling of gas and air.

At the cold end of the rotor housing 18, the rotor 10 is subjected to relatively minor thermal distortion; and any thermal distortion which does occur tends to move the rotor 10 toward the sector plate 30. Therefore, any existing clearance between the lower radial seals 34 and the lower sector plate 32 will be decreased resulting in an improved sealing relationship therebetween.

As mentioned previously herein, various schemes of compensating for the loss of sealing effectiveness at the hot end of the heat exchanger as a result of rotor turndown have been proposed. In one such scheme, the upper sector plate 30 is forced downward to recontact the upper radial seals 28 mounted on the upper end face of the rotor 10. Naturally, it is desirable to know the amount of turndown of the rotor 10 before the upper sector plate 30 is adjusted, particularly at the outer end of the rotor 10, so that the upper radial seals 28 will not be damaged by an operator who unknowingly overcompensates for rotor turndown.

Figure 2:
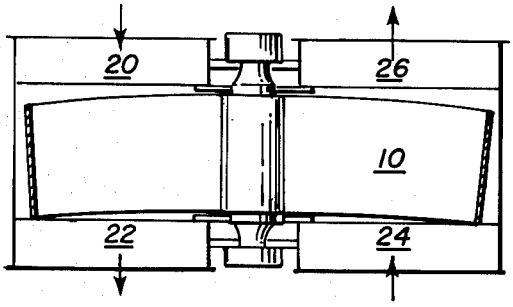
FIG. 2 is a diagrammatic representation of a rotary regenerative heat exchange apparatus experiencing rotor turndown.

Accordingly, turndown indicator means 40 is mounted to the upper sector plate 30 at a location near the outboard end of the rotor 10. Thus, when the heat exchanger is in operation and the rotor 10 turns down as illustrated in FIG. 2, the turndown indicator means 40 can be actuated to give an accurate indicator of the amount of turndown.

Figure 3:
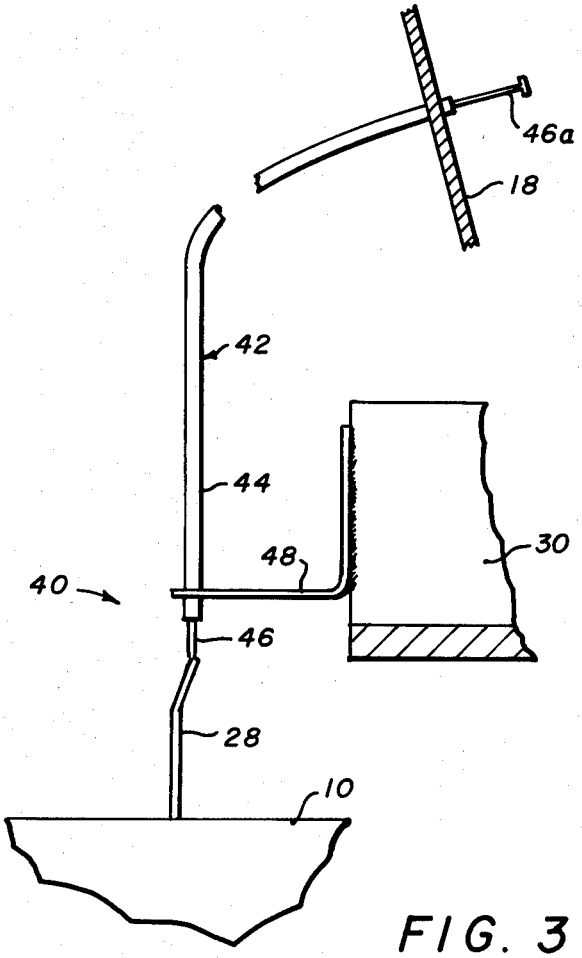
FIG. 3 is a detailed elevational view showing a rudimentary embodiment of the turndown indicator.

In accordance with the present invention, the turndown indicator means 40 in its more rudimentary embodiment as shown in FIG. 3, comprises a flexible cable assembly 42 formed of a flexible tubular cable housing 44 and a flexible cable 46 adapted to move slidably within and extend through the cable housing 44 and means 80 operatively associated with the flexible cable 46 for indicating the amount of displacement of the cable 46. Cable housing 44 is adapted to extend from the upper sector plate 30 through the rotor housing 18 to a location external to the heat exchanger. One end of cable housing 44 is mounted in fixed position to the upper sector plate 30, either directly or indirectly by support means such as angle piece 48, while the other end is mounted in fixed position to the rotor housing 18. Thus, a fixed length of cable housing is provided between the upper sector plate 30 and the rotor housing 18. However, because of the flexibility of the tubular cable housing 44, the upper sector plate is free to move without breaking or lengthening the cable housing 44.

Extending through the flexible tubular cable housing 44 is a flexible cable 46 which is adapted, i.e., sized, to slidably move through the flexible tubular cable housing 44 when an axial force is applied to the end **46*a* of cable 46 which extends out of the end of cable housing 44 mounted to the rotor housing 18. When in the set position, as shown in FIG. 3, the upper radial seals 28 of rotor 10 are in contact with the upper sector plate 30, the flexible cable 46 of the turndown indicator 40 is adjusted to extend out of the opposite ends of the cable housing 44 so as to just contact radial seals 28**.

When the heat exchanger is placed in operation, rotor 10 turns down causing the radial seals 28 to move away from and lose contact with the upper sector plate 30. To again bring the sector plate 30 in contact with the radial seals 28 and thereby again establish a sealing relationship therebetween, the operator can cause the upper sector plate 30 to bend downward to recontact the radial seals 28. Before so doing, the operator can manually push the end **46*a* of the flexible cable 46 into the tubular cable housing 44 until sufficient resistance is met thereby indicating that the tip of the opposite end of the flexible cable 46 is again contacting the radial seals 28. By noting the displacement of the end 46*a* of the cable 46 extending out of cable housing 42 as indicated on indicator means 80, typically a scale, the operator can determine the amount of rotor turndown that exists prior to adjusting the upper sector plate 30. Because cable 46 and cable housing 44 are flexible, they will give in the event that the operator continues to apply force after contact between the cable 46 and the radial seals 28** is reestablished. Thus, damage to the radial seals or to the turndown indicator itself is avoided.

Figure 4:
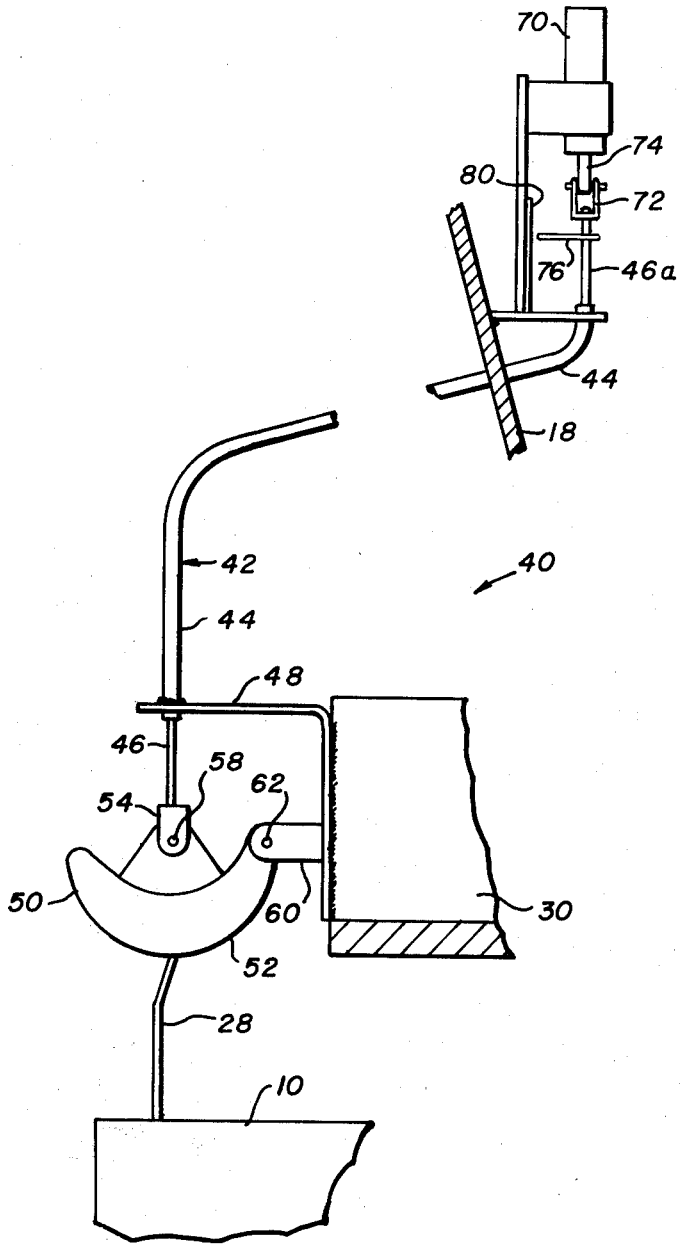
FIG. 4 is a detailed elevational view showing the preferred embodiment of the turndown indicator.

In accordance with the preferred embodiment of the present invention as shown in FIG. 4, the turndown indicator 40 comprises in addition to the flexible cable assembly 42 and indicator means 80, a generally semicircular swing cam 50 pivotally cantilevered from the outboard end of the upper sector plate 30 and pivotally connected at its center to the end of the flexible cable 46 and actuation means 70 operatively associated with the flexible cable 46 for controlling the force applied to push the flexible cable 46 through the cable housing 44 in order to bring the cam 50 into contact with the radial seals 28.

As illustrated in FIG. 4, swing cam 50 comprises in the preferred embodiment a disc having a semicircular outer circumferential contact surface 52 for contacting the radial seals 28. Swing cam 50 is pivotally connected through knuckle 54 to the end of the flexible cable 46 so as to rotate freely about pivot point 58 which is coincident with the center of the semicircular arc forming the outer circumferential contact surface 52 of the swing cam 50. Cam 50 is additionally pivotally mounted to and cantilevered from the upper sector plate 30 through knuckle 60 so as to freely rotate about pivot point 62 in response to an axial force applied to the end 46*a* of flexible cable 46.

The turndown indicator illustrated in FIG. 4 is in the set position, i.e., the position which the swing cam 50 would assume with the rotor 10 at rest at ambient temperature prior to operation of the heat exchanger. The operation of the turndown indicator can best be described with reference to FIG. 5 wherein the rotor 10 is depicted in operation experiencing turndown due to thermal deformation.

Figure 5:
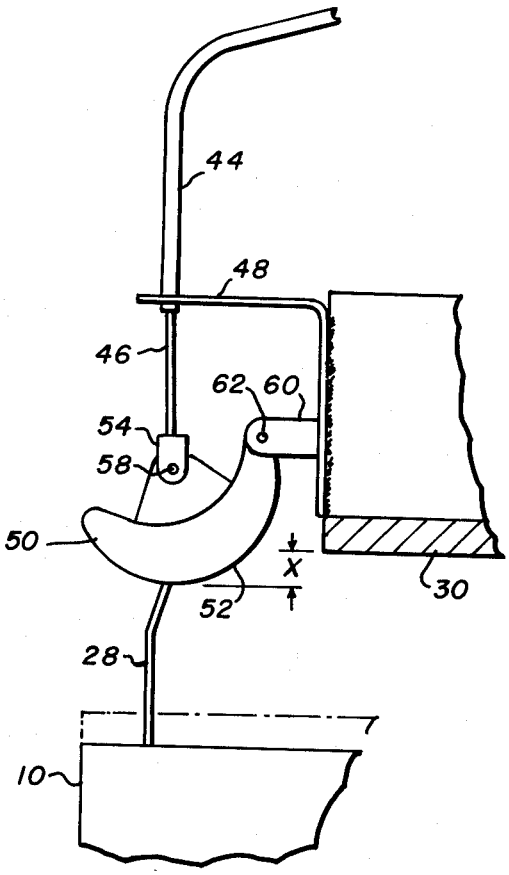
FIG. 5 is a close-up detailed elevational view of the turndown indicator in operation.

In FIG. 5, the rotor 10 is depicted as moving from right to left as indicated by the arrow and as being distorted radially outward and downward from its rest position which is indicated by the dashed lines. In this turndown position, the radial seals 28 along the upper end face of the rotor 10 are no longer in contact with the upper sector plate 30. In order to determine the amount of turndown present, the operator actuates the actuation means 70 to push the flexible cable 46 through the cable housing 44 thereby rotating the cantilevered swing cam 50 about pivot point 62 until the outer circumferential contact surface 52 of the cam is again making contact with the radial seals 28 as they rotate by.

Because the outer circumferential contact surface 52 of the swing cam 50 is a semicircular arc of a circle having its center at the pivot point 58 at which the swing cam is attached to the end of the flexible cable 46, the distance between the contact surface 52 of the cam 50 and the end of cable 46 is fixed. Further, as mentioned previously, the length of the flexible cable housing 44 is also fixed. Thus the amount of turndown present is accurately indicated by the displacement of the externally extending end 46*a* of the cable 46 from its set position to the position it assumes at the instant of recontact of the swing cam 50 with the radial seals 28.

In order to prevent damage to the radial seals 28 or to the turndown indicator itself, actuation means 70 is provided to control the force applied, particularly at the instant of contact, when pushing the flexible cable 46 through the cable housing 44. In the preferred embodiment of the present invention, actuating means 70 comprises a fluidic cylinder mounted on the external surface of the rotor housing 18. Referring again to FIG. 4, the externally extending end 46*a* of the flexible cable 46 is attached by knuckle and pin assembly 72 to the piston rod 74 of the fluidic cylinder 70.

In operation, the fluidic cylinder 70 is actuated to apply a force to the externally extending end 46*a* of the flexible cable 46 to push the cable 46 through the cable housing 44 and thereby move the swing cam 50 back in contact with the upper radial seals 28 mounted on the rotating rotor 10. When the swing cam 50 first recontacts a seal, fluid is exhausted from the fluidic cylinder 70 thereby cushioning the impact of the swing cam 50 against the seals 28 and halting further movement of the cable 46. Repeated contact of successive radial seals 28 with the swing cam 50 as the rotor 10 rotates, dampens out any further movement of the swing cam 50 and assures that the swing cam 50 comes to rest at the very point of recontact with the seals. Since at typical rotation speeds successive contact of the radial seals 28 with the swing cam 50 will occur at approximately one and one-half second intervals, the swing cam 50 will quickly assume a steady-state position.

Once the swing cam 50 has assumed a steady-state position, the displacement of an indicator means operatively associated with the swing cam 50, such as pointer 76 attached to the externally extending end 46*a* of cable 46 and scale 80 associated with the pointer 76, provides the operator with an accurate measurement of the amount of turndown being experienced by the rotor. The upper sector plate 30 may now be deflected to compensate for the now-known amount of turndown and thereby reestablish a sealing relationship with the rotor 10 without fear of damaging the radial seals 28. This deflection may be initiated manually by the operator or through automatic control means in response to the displacement of the indicator means. If a deflectable sector plate is not being used, other sealing means known in the art can be employed to compensate for the now-known amount of turndown.

While the present invention has been described herein with reference to the embodiments illustrated in the accompanying drawing, it will be appreciated that modifications thereof may still be readily made by those skilled in the art. It is, therefore, intended that all modifications which may fall within the spirit and scope of the present invention as defined herein, and as limited only by the appended claims, shall be covered.

I claim:

1. In combination with a rotary regenerative heat exchange apparatus having a hollow cylinder rotor, a central rotor post about which the rotor rotates, a mass of heat absorbent material carried within the rotor, a housing surrounding the rotor including inlet and outlet ducts at opposite ends thereof for establishing a first fluid passageway for passing a heating fluid through the rotor and a second fluid passageway for passing a fluid to be heated through the rotor in a direction opposite to the flow of the heating fluid, a sector plate disposed at the hot end of the rotor at a location intermediate the end of the rotor and the rotor housing adapted to maintain the heating fluid entering the rotor separate from the heated fluid leaving the rotor and a plurality of radial seals mounted on the end face of the rotor at spaced intervals about the rotor post so as to contact the sector plate and thereby establish a sealing relationship between the rotor and the sector plate; a turndown indicator comprising:

a. a fixed length of flexible tubular cable housing extending from the sector plate through the rotor housing to a location external thereto;

b. a flexible cable adapted to move slidably through said tubular cable housing, said flexible cable havng a first end extending out of the end of said tubular cable housing located external to the rotor housing and a second end extending out of the opposite end of said tubular cable housing to a location in close proximity with the radial seals; and c. indicator means operatively associated with said flexible cable for indicating the amount of displacement of said flexible cable from a set position.

2. An apparatus as recited in claim 1 wherein said turndown indicator further comprises a boomerang-shaped disc-like swing cam having a semicircular outer circumferential surface for contacting the radial seals, said swing cam being pivotally connected to the second end of said flexible cable about a first point coincident with the center of the semicircular arc proscribing the outer circumferential surface thereof and being cantilevered from and pivotally mounted to the sector plate so as to be free to rotate about said mounting point in response to an axial force applied to the first end of said flexible cable.

3. An apparatus as recited in claim 2 wherein said turndown indicator further comprises actuation means for applying a controlled axial force to the first end of said flexible cable so as to cause said swing cam to rotate about said mounting point.

4. An apparatus as recited in claim 3 wherein said actuation means is adapted to stop applying an axial force to said flexible cable whenever said swing cam contacts a radial seal.

* * * * *